US009704307B2

(12) United States Patent
Owen et al.

(10) Patent No.: US 9,704,307 B2
(45) Date of Patent: Jul. 11, 2017

(54) VEHICLE DIAGNOSTICS APPARATUS, DIAGNOSTICS UNIT AND METHODS

(71) Applicant: JAGUAR LAND ROVER LIMITED, Warwickshire (GB)

(72) Inventors: Robert Owen, Coventry (GB); Jason Treharne, Coventry (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 0 days.

(21) Appl. No.: 14/786,216

(22) PCT Filed: Apr. 17, 2014

(86) PCT No.: PCT/EP2014/057918
§ 371 (c)(1),
(2) Date: Oct. 22, 2015

(87) PCT Pub. No.: WO2014/173818
PCT Pub. Date: Oct. 30, 2014

(65) Prior Publication Data

US 2016/0071336 A1 Mar. 10, 2016

(30) Foreign Application Priority Data

Apr. 26, 2013 (GB) ..... 1307527.0

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC ..... G07C 5/0808; G07C 5/008
See application file for complete search history.

(56) References Cited

U.S. PATENT DOCUMENTS 5,214,582 A 5/1993 Gray
5,318,449 A 6/1994 Schoell et al.
(Continued)

FOREIGN PATENT DOCUMENTS

CN 102494754 A 6/2012
EP 1116955 A2 7/2001
(Continued)

OTHER PUBLICATIONS

International Search Report for International application No. PCT/EP2014/051924 mailed Apr. 28, 2014.
(Continued)

*Primary Examiner* — Michael D Lang
(74) *Attorney, Agent, or Firm* — Carlson, Gaskey & Olds

(57) ABSTRACT

A diagnostics unit (10) for detecting a noise, vibration, harshness (NVH) type fault observed by a user of a vehicle (90). The diagnostics unit (10) comprising: a stud type attachment means (20) for rigidly attaching the diagnostics unit (10) to a test component (30) of the vehicle (90), for example a transfer case (30). The diagnostics unit (10) also comprises an accelerometer (28*a*, 28*b*) for detecting a force of acceleration in at least one axial direction ('X'). A power source (27) is provided within the diagnostics unit (10) along with a Bluetooth® data transmitter (25) for transmitting data gathered by the accelerometer (28*a*, 28*b*) of the diagnostics unit (10) to a computing device (50), such as a lap-top disposed within the vehicle (90). The data is analysed by the lap-top (50) to identify which component of the transfer case (30) (for example, gear, chain, bearing) is faulty.

22 Claims, 6 Drawing Sheets

(56) References Cited

U.S. PATENT DOCUMENTS

| | | | | |
|---|---|---|---|---|
| 5,532,927 | A | 7/1996 | Pink et al. | |
| 5,798,647 | A | 8/1998 | Martin et al. | |
| 6,055,468 | A | 4/2000 | Kaman et al. | |
| 6,481,271 | B1 | 11/2002 | Ward et al. | |
| 7,913,242 | B2 | 3/2011 | Holland | |
| 2003/0005765 | A1* | 1/2003 | Brudis | G08G 1/167 73/488 |
| 2003/0088346 | A1 | 5/2003 | Calkins et al. | |
| 2003/0216889 | A1 | 11/2003 | Marko et al. | |
| 2004/0138790 | A1 | 7/2004 | Kapolka et al. | |
| 2004/0239516 | A1 | 12/2004 | Jones et al. | |
| 2005/0034540 | A1 | 2/2005 | Juranitch et al. | |
| 2005/0049835 | A1 | 3/2005 | Mayer et al. | |
| 2006/0106510 | A1 | 5/2006 | Heffington | |
| 2007/0028220 | A1 | 2/2007 | Miller et al. | |
| 2008/0284575 | A1* | 11/2008 | Breed | B60C 23/0493 340/438 |
| 2008/0297334 | A1 | 12/2008 | Siavoshai et al. | |
| 2010/0049395 | A1 | 2/2010 | Duddle et al. | |
| 2010/0205450 | A1 | 8/2010 | Sarnacke et al. | |
| 2012/0041638 | A1 | 2/2012 | Johnson et al. | |
| 2013/0066512 | A1 | 3/2013 | Willard et al. | |
| 2014/0005881 | A1 | 1/2014 | Hardesty | |
| 2014/0075356 | A1 | 3/2014 | Gray et al. | |
| 2015/0371461 | A1 | 12/2015 | Treharne | |
| 2016/0071336 | A1 | 3/2016 | Owen et al. | |

FOREIGN PATENT DOCUMENTS

| | | | |
|---|---|---|---|
| EP | 0913694 | B1 | 12/2003 |
| EP | 1978490 | A1 | 10/2008 |
| GB | 2221544 | A | 2/1990 |
| WO | 2007027702 | A2 | 3/2007 |

OTHER PUBLICATIONS

Combined Search and Examination Report under Sections 17 and 18(3) for Application No. GB1301803.1 dated Jul. 31, 2013.

Combined Search and Examination Report under Sections 17 and 18(3) for Application No. GB1307527.0 dated Nov. 27, 2013.

Search Report under Section 17(6) for Application No. GB1307527.0 dated Apr. 10, 2014.

International Search Report for International application No. PCT/EP2014/057918 dated Oct. 21, 2014.

Combined Search and Examination Report under Sections 17 and 18(3) for Application No. GB1502332.8 dated Feb. 19, 2015.

* cited by examiner

VEHICLE DIAGNOSTICS APPARATUS, DIAGNOSTICS UNIT AND METHODS

TECHNICAL FIELD

The present invention relates to a vehicle diagnostics apparatus, to a vehicle diagnostics unit, to a method of diagnosing a vehicle fault and to a method of checking the calibration of the vehicle diagnostics unit. Particularly, but not exclusively, the invention relates to a vehicle diagnostics apparatus for diagnosing a noise, vibration and harshness (NVH) type vehicle fault. Aspects of the invention relate to an apparatus, to a unit, to methods and to a vehicle.

BACKGROUND

It is known to provide a vehicle diagnostics apparatus that connects to a diagnostics input port of a motor vehicle to facilitate interrogation of a vehicle electronic control unit (ECU). Known diagnostics apparatus is configured to read fault codes that are stored in a memory of the ECU when the ECU determines that a fault has occurred. The diagnostics apparatus typically provides an output to an operator indicative of the fault codes identified by the apparatus. Known diagnostics apparatus may be operable to command an ECU to which it is connected via the diagnostics port to perform a particular diagnostic test and to read back from the ECU a result of the test.

A problem with known diagnostics apparatus is that it is not readily able to facilitate diagnosis of a noise, vibration, harshness (NVH) type fault. Such faults are typically recognised by a user of the vehicle noticing a noise, a vibration or a harshness that is not considered to be normal. Such faults can be very difficult to diagnose and can take considerable time and effort by an automotive technician who may only be able to apply a trial and error technique to identifying the component(s) of the vehicle that is faulty. Such a technique will often result in working parts being removed and replaced needlessly in an attempt to isolate the faulty component. This is wasteful and involves unnecessary costs which include not only the material cost of an unrequired replacement part and the labour costs in the time intensive trial and error procedure, but also the costs that are involved in testing the removed part, which is typically returned to the supplier of the part for analysis.

It is desirable therefore to be able to quickly and cost effectively identify the source of an NVH type fault. It is also desirable to clearly direct the automotive technicians as to the lowest cost and most effective repair in order to address the NVH fault.

It is an aim of the present invention to provide an improvement in the field of fault diagnosis.

SUMMARY OF THE INVENTION

Aspects of the invention provide an apparatus, a unit, a vehicle and methods as claimed in the appended claims.

According to an aspect of the invention, there is provided a diagnostics unit for use with an external diagnostics apparatus for detecting a noise, vibration, harshness (NVH) type vehicle fault, the diagnostics unit comprising: a first attachment means for rigidly attaching the diagnostics unit to a component of a vehicle; sensing means for detecting changes in velocity and/or acceleration in at least one axial direction; a communication means for wirelessly transmitting and/or a memory means for storing data gathered by the sensing means of the diagnostics unit to an external diagnostics apparatus and a power source coupled to the sensing means and the communication means.

Optionally, the sensing means comprises at least one accelerometer selected from the group comprising: a capacitive accelerometer, a piezoelectric accelerometer, a piezoresistive accelerometer and a Hall Effect accelerometer.

The sensing means may comprise a first accelerometer and a second accelerometer and the first accelerometer and the second accelerometer may be configured to detect acceleration in only one axial direction and in the same axial direction. The first and second accelerometers may have different operating ranges.

Optionally, the first accelerometer is a piezoelectric accelerometer and wherein the second accelerometer is a MEMS (micro-electromechanical system) accelerometer.

The first accelerometer may have an operating range of −20 g to 20 g and the second accelerometer may have an operating range of −70 g to 70 g.

Optionally, the diagnostics unit further comprises one or more analogue to digital converters and one or more microcontrollers.

Optionally, the diagnostics unit further comprises a first analogue to digital converter for said first accelerometer and a second analogue to digital converter for said second accelerometer.

Further optionally, the attachment means for rigidly attaching the diagnostics unit to a component of a vehicle comprises a threaded nut fittable to a complementary stud mounted to said component of the vehicle.

The communication means may comprise a Bluetooth® wireless communication device. The diagnostics unit may additionally comprise a Universal Serial Bus (USB) port for wired communication with an external diagnostics apparatus and/or for charging said power source.

A protective cover may be attached to the diagnostics unit for closing and protecting the USB port.

The diagnostics unit may comprise a further attachment means for attaching the diagnostics unit to the vehicle at a second location said second location being spaced from the location at which the first attachment means is attached to said component of the vehicle. Said further attachment means may be a tether.

The diagnostics unit may comprise a housing, the first attachment means may at least partially stand proud of the housing for attaching the diagnostics unit to said component of a vehicle and the sensing means and power source may be disposed entirely within the housing and may be protected by the housing.

Optionally, said component of the vehicle to which the diagnostics unit is rigidly attachable contains a device or is connected to a device giving rise to the noise, vibration, harshness (NVH) type vehicle fault and wherein said device is selected from the group comprising: crank-shaft, timing chain, gear, differential gear, bearing, fly-wheel, injector and diesel injector pintle valve.

According to an aspect of the invention, there is provided a vehicle comprising a component, a complementary fixing means mounted to said component of the vehicle and comprising a diagnostics unit according to any of the relevant preceding paragraphs, wherein said attachment means for rigidly attaching the diagnostics unit to a component of a vehicle is rigidly affixed to said complementary fixing means.

Optionally, the attachment means of the diagnostics unit comprises a screw thread and is structured and arranged such that when the attachment means is screw-fixed to the fixing means on said component of the vehicle, the sensing means is accurately positioned for detecting a force of acceleration in at least one axial direction that is parallel to a notional axis passing through the centre of the attachment means.

Optionally, said fixing means comprises a mounting plate and a stud, said stud structured and arranged for screw-fixing the attachment means of the diagnostics unit thereto and the mounting plate for attaching the fixing means to said component of the vehicle in a correct orientation.

Optionally, said component of the vehicle to which the diagnostics unit is rigidly attached contains a device or is connected to a device giving rise to the noise, vibration, harshness (NVH) type vehicle fault and wherein said device is selected from the group comprising: crank-shaft, timing chain, gear, differential gear, bearing, fly-wheel, injector and diesel injector pintle valve.

According to an aspect of the invention, there is provided a method of diagnosing a noise, vibration and harshness (NVH) type vehicle fault, the method comprising performing one or more test cycles, wherein each test cycle comprises:

issuing instructions for a vehicle to be driven in accordance with a set of conditions for each test cycle;

whilst the vehicle is being driven in accordance with the set of conditions, digitally sampling, for one or more time periods, the acceleration of a vehicle component in a first axial direction;

converting the digitally sampled data obtained during each of the one or more time periods into the frequency domain, such that data of acceleration force against frequency is obtained for each of the one or more time periods;

applying predetermined upper and/or lower acceleration force limits for each of the one or more predetermined frequency bands, which predetermined frequency bands identify one or more vehicle components;

and the method further comprises:

assigning a pass or fail for each of said one or more predetermined frequency bands in dependence upon whether the acceleration force at each of said one or more predetermined frequency bands falls within or falls outside of the predetermined upper and/or lower acceleration force limits; and upon assigning a critical number of fails within a maximum number of test cycles, issuing a diagnostic report that one or more vehicle components or devices contained therein is faulty; that one or more vehicle components should be replaced; or upon not assigning a critical number of fails within the maximum number of test cycles, issuing a diagnostic report that other devices of the vehicle need to be tested.

Optionally, said set of conditions for each test cycle comprises a specified vehicle target speed, a specified driving mode, a specified vehicle transmission gear, a specified drive shaft speed and/or a specified engine load.

Optionally, the method further comprises validating the test cycle by: during the test cycle, continuously or intermittently, checking whether the actual vehicle conditions at least substantially match the specified set of conditions. Validating the test cycle may be conducted before, the step of digitally sampling, for one or more time periods, the acceleration of a vehicle component in a first axial direction and wherein upon determining that the test cycle is not yet valid said step of digitally sampling, for one or more time periods, the acceleration of a vehicle component in a first axial direction is not carried out.

Upon determining that the test cycle is not yet valid, the method may additionally comprise continuing that test cycle with the same pre-set conditions for the test cycle and issuing correction instructions to encourage the vehicle to be driven in accordance with the pre-set conditions for the test cycle.

Optionally, after said step of converting the digitally sampled data obtained during each of the one or more time periods into the frequency domain, the data of acceleration force against frequency obtained for each of the one or more time periods is averaged over the total number of said one or more time periods and wherein the step of assigning a pass or fail is thereby carried out once per test cycle.

Optionally, the critical number is four and wherein the maximum number is seven.

Optionally, said digitally sampling comprises, using a diagnostics unit according to claim 8.

Optionally, the sensing means of the diagnostic unit comprises a first accelerometer and a second accelerometer, wherein the method additionally comprises comparing data from the first accelerometer and the data from the second accelerometer obtained within a sampling period in order to verify that the first and second accelerometers are within calibration.

Optionally, said sampling period is the same duration as each of said one or more time periods.

Optionally, during each sampling period the first and second accelerometers are alternately sampled or wherein during each sampling period the first and second accelerometers are simultaneously sampled.

Optionally, said step of comparing the data from the first accelerometer and the data from the second accelerometer obtained within a sampling period in order to verify that the first and second accelerometers are within calibration comprises:

comparing a mean of the data from the first accelerometer with a mean of the data from the second accelerometer; and/or comparing a standard deviation of the data from the first accelerometer with a standard deviation of the data from the second accelerometer.

Within the scope of this application it is expressly intended that the various aspects, embodiments, examples and alternatives set out in the preceding paragraphs, in the claims and/or in the following description and drawings, and in particular the individual features thereof, may be taken independently or in any combination. Features described with reference to one embodiment are applicable to all embodiments, unless such features are incompatible.

BRIEF DESCRIPTION OF THE DRAWINGS

One or more embodiments of the invention will now be described, by way of example only, with reference to the accompanying drawings, in which.

DETAILED DESCRIPTION OF EMBODIMENTS

Detailed descriptions of specific embodiments of the diagnostics apparatus, diagnostics units, methods and vehicles of the present invention are disclosed herein. It will be understood that the disclosed embodiments are merely examples of the way in which certain aspects of the invention can be implemented and do not represent an exhaustive list of all of the ways the invention may be embodied. Indeed, it will be understood that the diagnostics apparatus, diagnostics units, methods and vehicles described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
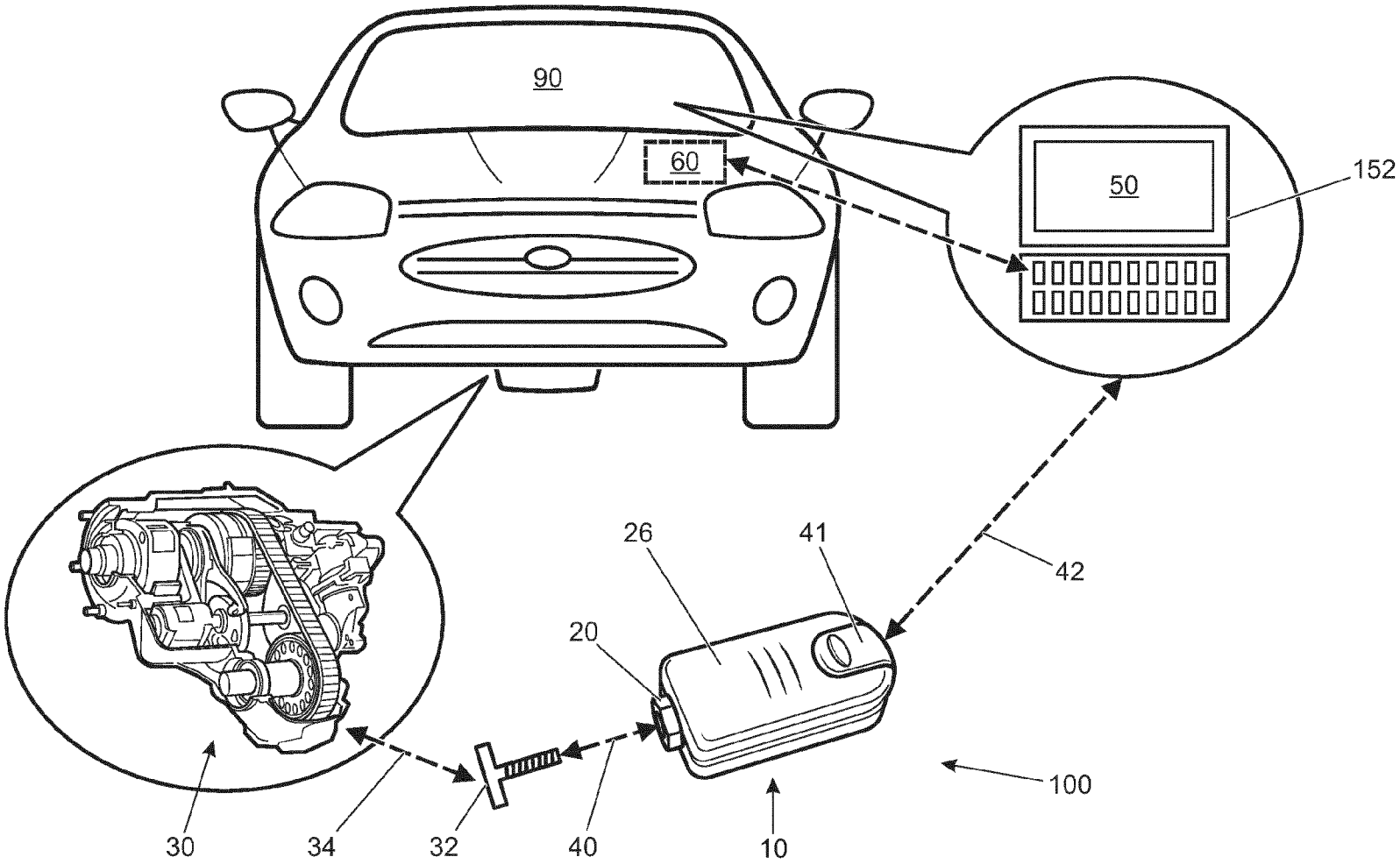
FIG. 1 is a schematic illustration of a vehicle diagnostics system in use on a vehicle, the system comprises a diagnostics unit and the vehicle diagnostics system is coupled to the vehicle.

Referring to FIG. 1 a diagnostics system 100 for a vehicle 90 is shown. The diagnostics system 100 has been designed for detecting a noise, vibration and harshness (NVH) type vehicle fault. Such a fault may be observed by a user of the vehicle 90. Many components of the vehicle 90 if faulty may give rise to a noise, vibration or harshness that is not normal. In the present disclosure, diagnosing an NVH type vehicle fault is carried out by gathering vibration data from a wireless enabled diagnostics unit 10 under pre-set control conditions of the vehicle 90, analysing the data and identifying one or more faulty components by their vibration frequency signature. Control data is gathered empirically, this is done by operating a vehicle 90 under pre-set control conditions using a diagnostic unit 10 located at an appropriate place on control components. In some embodiments the control vehicle comprises components having known identified faults. In other embodiments the control vehicle comprises components which do not have a fault. A frequency signature database is thereby obtained which comprises vibration frequency signatures for various faulty and/or non-faulty components of the vehicle 90. The "vibration frequency signatures" may be characterised by an upper and or lower vibration magnitude threshold for one or more frequency bands or orders. In the present invention a database of vibration frequency signature characteristics for a variety of vehicle components is stored by the diagnostics system 100 for reference by the diagnostics system 100 in determining whether a component under test has passed or failed the diagnostics test.

The system 100 is structured and arranged to issue an advisory as to the most cost effective and/or as to the quickest repair to address the fault detected based upon a variety of factors. Beneficially therefore the system 100 does not present a technician using the diagnostics system with graphical data (such as that shown in FIG. 4) for the technician to interpret, but rather provides a very clear instruction as to which component has been determined as faulty and/or a very clear instruction as to how to resolve the fault. For example, if the system 100 determines that a bearing and a chain comprised in a transfer case are faulty, the system 100 may indicate that the entire transfer case should be replaced rather than informing the technician that the bearing and chain are both faulty. In this way the vehicle manufacturer retains control of how their vehicles are serviced and maintained, which may be valuable for safety, client care, economical and/or commercial reasons.

In the illustrated arrangement of FIG. 1, a test component 30 of the vehicle 90 is being tested. In the illustrated embodiment, the test component 30 is a transfer case of the four-wheel drive vehicle 90 and is being tested using a single diagnostics unit 10. In other embodiments, the component 30 of the vehicle 90 being tested may be any other component of the vehicle 90 that is accessible for the diagnostics unit 10 to be mounted thereto and which might reasonably give rise to an NVH type fault. Such components may include as non-limiting examples: a front differential, a transfer case, a rear differential. The component of the vehicle 30 that the diagnostics unit 10 is rigidly attached to may itself contain or be connected to other devices and the vibrations detected by the diagnostics unit 10 may be indicative of a failure of one or more of those other devices. Such other devices may include, as non-limiting examples: a crank-shaft, a timing chain, a gear, a bearing, a fly-wheel, an injector and a diesel injector pintle valve.

Referring again to FIG. 1, the diagnostics unit 10 gathers vibration data from the transfer case 30 whilst the vehicle 90 is being driven. The diagnostics system 100 further comprises a diagnostics apparatus 152, which may comprise a computing device 50 and one or more additional diagnostics units, such as but not limited to an in-line diagnostics unit (IDU) (not shown). The diagnostics apparatus 152 is coupled to an Electronic control unit (ECU) 60 of the vehicle 90 via a communications link (see FIG. 1).

To control the diagnostic tests, the vehicle 10 is driven under specified, pre-set control conditions that are monitored throughout the diagnostic test. One or more test cycles may be conducted, each at specified pre-set control conditions. The pre-set conditions may be stored in a memory associated with the computing device 50 or diagnostics apparatus 152 and may be selected in dependence upon the type of component 30 under test. The pre-sect conditions may include: a specified vehicle target speed, a specified driving mode (for example sports mode), a specified vehicle gear, a specified drive shaft speed and/or a specified engine load. Some or all of the specified conditions may be issued to a technician conducting the diagnostics test so that the technician can drive the vehicle 90 under test in the appropriate way. By conducting the diagnostics test under specified control conditions, the vibration data obtained by the diagnostics unit 10 can be compared with the control data for the relevant test component so that a determination as to whether the test component 30 has passed or failed the diagnostics test can be made accurately.

To verify that a test cycle has been conducted within the specified test conditions, the diagnostics apparatus 152 is coupled to the ECU of the vehicle 10 in order to determine the actual conditions, in other words, the actual vehicle speed, the actual drive mode, the actual vehicle transmission gear, the actual drive shaft speed and/or the actual engine load. Such parameters may be obtained via a communication link with the vehicle 90 controller area network (CAN) or other auxiliary vehicle control unit, and/or by direct communication with the ECU 60. Such parameters may be derived from one or more of the other parameters.

Figure 2:
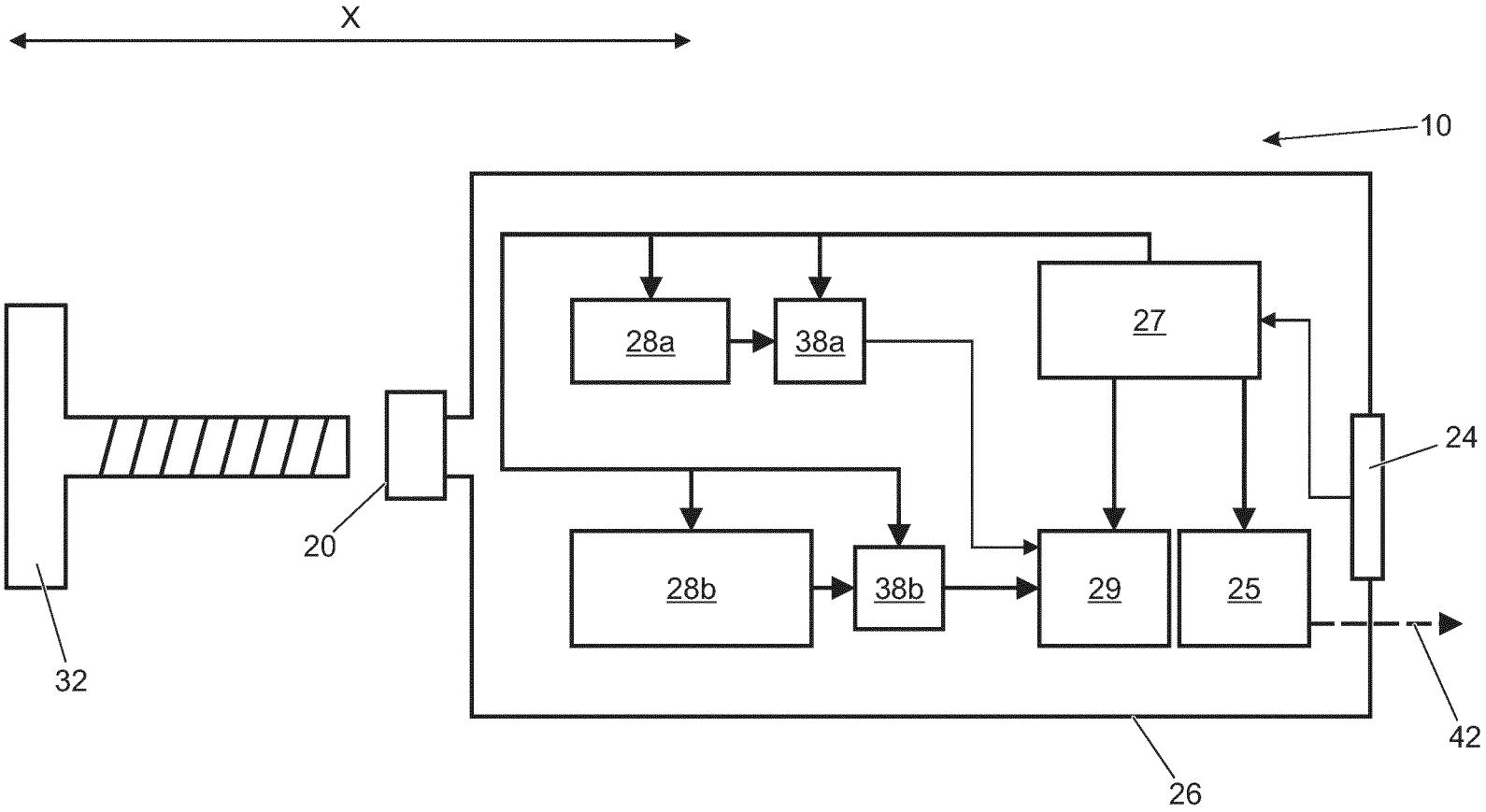
FIG. 2 is a schematic illustration of the diagnostics unit and a fixing means comprised in the vehicle diagnostics system of FIG. 1.

Referring now to FIG. 2, the diagnostics unit 10 and a fixing means 32 are shown schematically. The diagnostics unit 10 comprises: a first attachment means 20; sensing means 28*a*, 28*b* for detecting vibrations by measuring changes in acceleration in at least one axial direction ('X'); a communication means 25; a power source 27; a first analogue to digital converter (ADC) 38*a;* a second analogue to digital converter (ADC) 38*b;* a microcontroller 29; a communications and/or charging port 24; and a housing 26.

The first attachment means 20 is provided for rigidly attaching the diagnostics unit 10 to a test component 30 of the vehicle 90 via a connection 40 with the fixing means 32. A rigid attachment is necessary so that any vibrations of the test component 30 are translated accurately to the sensing means 28*a*, 28*b* of the diagnostics unit 10. The fixing means 32 is mounted to the test component 30, via a connection 34 that may be provided by a suitable adhesive. The fixing means 32 is an external screw thread such as a threaded stud on a mounting plate (see FIGS. 1 and 2). The first attachment means 20 comprises an internal screw thread for example a nut or integrally formed on the diagnostics unit 10. The first attachment means 20 rigidly attaches the diagnostics unit 10 to the test component 30 of the vehicle 90 via a screw-fit 40 of the internal screw thread and the complementary stud of the fixing means 32; and via the adhesive connection 34 of the fixing means 32 to the test component 30.

To gather data relating to a change in motion (vibration), the sensing means 28*a*, 28*b* comprises at least one accelerometer 28*a*, 28*b*. In the present arrangement the sensing means 28*a*, 28*b* comprises a first accelerometer 28*a* and a second accelerometer 28*b*. The first accelerometer 28*a* and the second accelerometer 28*b* are configured to detect acceleration in only one axial direction ('X') and are configured to detect acceleration in the same axial direction ('X') as one another. In other embodiments it is envisaged that one or more accelerometers could be deployed. In envisaged embodiments, one or more accelerometers are provided and are configured to detect changes in acceleration in more than one axial direction either individually or collectively. However, the presently illustrated arrangement is advantageous because the use of two accelerometers 28*a*, 28*b* operating in the same axial direction provides a way of validating the data obtained by the two accelerometers 28*a*, 28*b* (this is explained in further detail below). Furthermore, different types of accelerometer 28*a*, 28*b* are used. In the present arrangement, the first accelerometer 28*a* is a piezoelectric accelerometer and the second accelerometer 28*b* is a MEMS accelerometer.

Owing to the different designs of the first and second accelerometers 28*a*, 28*b* they have different operating ranges. This is optional. The first accelerometer 28*a* has an operating range of about −20 g to about 20 g and the second accelerometer 28*b* has an operating range of about −70 g to about 70 g. In this way, first accelerometer 28*a* has a sufficient bandwidth to capture data across the full range of expected acceleration forces for the diagnostic application and the second accelerometer 28*b* has a narrower bandwidth and may have a higher resolution within the narrower acceleration force range. In other envisaged embodiments two accelerometers are used and they are of the same type. In yet further envisaged embodiments two accelerometers are used and they are of different types. In other embodiments, it is envisaged that the first accelerometer 28*a* and/or the second accelerometer 28*b* are selected from the group comprising: a capacitive accelerometer, a piezoelectric accelerometer, a piezoresistive accelerometer, a MEMs accelerometer and a Hall Effect accelerometer.

The first and second analogue to digital converters 38*a*, 38*b* are provided to convert the analogue electrical data signals output by the first and second analogue accelerometers 28*a*, 28*b* into digital signals that are then input to the digital microcontroller 29. In other envisaged embodiments one or more analogue to digital converters are omitted because either the or each accelerometer provides a digital output and/or because the microcontroller 29 accepts analogue inputs. In order to balance the amount of processing to be conducted by the microcontroller 29 and the power consumption of the active components contained within the diagnostics unit 10, in the present embodiment it is preferred to utilise a digital microcontroller 29, two analogue to digital converters 38*a*, 38*b* and two analogue accelerometers 28*a*, 28*b*. In this way a sufficient amount of data of sufficient accuracy can be gathered and processed as necessary within the time needed to carry out a full diagnostics test without exceeding the capacity of the power source 27. It would be impractical and almost unusable, if, during a diagnostics test, the diagnostics unit 10 had to be disconnected and re-charged. Optionally and again for balancing the amount of data gathered, its accuracy, the speed with which the data can be gathered and processed and the power required to achieve this, the first analogue to digital converter 38*a* is a 12 bit analogue to digital converter and the second analogue to digital converter is a 16 bit analogue to digital converter.

The 12 bit analogue to digital converter 38*a* converts analogue electrical signals output by the first accelerometer 28*a* to a number in the range of 0 to 2^12 (0 to 4096). The 16 bit analogue to digital converter 38*b* converts the analogue electrical signals output by the second accelerometer 28*b* into a number in the range of 0 to 2^16 (0 to 65536). In this embodiment, the first (12 bit) analogue to digital converter 38*a* is suitable for converting the analogue signal output by either the first or second accelerometer 28*a*, 28*b*. The output signals from the first and second accelerometers 28*a*, 28*b* are likely to be proportional to the force of acceleration of the test component 30 over time. As such, the actual (absolute or relative) force of acceleration of the test component 30 may not be directly output by the first or second accelerometers 28*a*, 28*b*, but can be derived therefrom. The acceleration force measured may be an absolute acceleration force or a relative acceleration force and the diagnostics system 100 will be configured to mathematically manipulate the obtained data in a manner appropriate to the nature of the data obtained in order to determine a magnitude of acceleration force that can be used in the diagnostic test.

The communication means 25 provides a wireless communication link 42 between the diagnostics unit 10 and the computing device 50 or other device of the diagnostics system 100. This enables, for example, the diagnostics apparatus 152 to issue commands or other communications signals to the diagnostics unit 10 and/or for communication signals to be issued by the diagnostics unit 10 to the diagnostics apparatus 152. Data gathered by the first and second accelerometers 28*a*, 28*b* of the diagnostics unit 10 is transmitted via the wireless communications link 42 to the external diagnostics apparatus 152 whereat the data is validated, analysed and interpreted. In the present embodiment, the communication means is Bluetooth® enabled. The Bluetooth® communications standard has been selected because: the range is suitable for facilitating effective communication between the diagnostics unit 10 mounted to the vehicle 90 and a computing device 50 which is disposed within the vehicle 90 during the test; and because the power consumption is relatively low. It will be recognised that other wireless communication means could be used in addition to or as an alternative to Bluetooth®.

The power source 27 is provided for supplying electrical power to the active components of the diagnostics unit 10. The power source 27 is at least coupled to the first accelerometer 28*a*, to the second accelerometer 28*b*, to the communication means 25, to the microcontroller 29 and to the first and second analogue to digital converters 38*a*, 38*b*. The power source 27 is optionally a rechargeable battery. The power source may be coupled directly or indirectly to the first accelerometer 28*a*, to the second accelerometer 28*b*, to the communication means 25, to the microcontroller 29 and to the first and second analogue to digital converters 38*a*, 38*b* via any suitable conduction means for example using wires and/or printed circuitry on a printed circuit board (PCB).

A charging and/or communication port 24 is additionally provided for coupling the diagnostics unit 10 to a power supply for re-charging the power source 27 and/or for coupling the diagnostics unit 10 to the computing device 50 of the diagnostics apparatus 152 for wired communication therewith. The charging and/or communication port 24 is preferably a Universal Serial Bus (USB) port 24.

Charging and/or wired communication via the USB port 24 is not carried out during a diagnostics test. During diagnostic testing, the diagnostics unit 10 is rigidly attached to the test component 30. The test component 30 may be difficult or awkward to access and/or may be exposed to harsh environmental conditions (for example, exposed to dirt, moisture and subjected to acceleration forces). Therefore, wired communication from the diagnostics unit 10 mounted to the test component 30 to a computing device 50 during testing is highly disadvantageous since any wires might become detached, damaged and tangled. It is for this reason also that the diagnostic unit 10 comprises the robust housing 26 to protect the components 28*a*, 28*b*, 25, 27, 38*a*, 38*b* contained within the diagnostics unit 10.

The first attachment means 20 at least partially stands proud of the housing 26 so that the nut of the first attachment means 20 can be screw-fixed to the stud of the fixing means 32. The USB port 24 is also exposed at another end of the diagnostics unit 10 (see FIGS. 1 and 2) for coupling to a computing device 50. A protective cover 41 is provided to protect the USB port 24 from damage, by for example, the ingress of dirt and water. The protective cover 41 is optionally formed from plastic and is clipped to the diagnostics unit 10 for closing and protecting the USB port 24 (see FIG. 1).

Finally, the diagnostics unit 10 comprises an optional further attachment means (not shown) for attaching the diagnostics unit 10 to the vehicle 90 at a second location. This provides a degree of redundancy and additional protection of the diagnostics unit 10 so that in use, if the connection 40 between the nut of the first attachment means 20 and stud of the fixing means 32 fails or the connection 34 between the fixing means 32 and test component 30 fails, the further attachment means can act as a fail-safe to ensure that the diagnostics unit 10 remains tethered to the vehicle 90. This advantageously mitigates against loss or damage of the diagnostics unit 10. The further attachment means is attached to the vehicle 90 at a second location that is spaced from the connection 34 (the location at which the fixing means 32 is attached to the vehicle 90). In the present embodiment, the further attachment means is a tether.

As described above, the nut of the first attachment means 20 of the diagnostics unit 10 comprises a screw thread and is structured and arranged such that when the first attachment means 20 is screw-fixed to the stud of the fixing means 32, which is mounted to the test component 30 of the vehicle 90, the first and second accelerometers 28*a*, 28*b* are accurately positioned, each for detecting a force of acceleration in one and the same pre-determined axial direction. The axial direction ('X') is parallel to a notional axis passing through the centre of the nut of the first attachment means 20 and is orthogonal to the plane of the mounting plate of the fixing means 32. To control the diagnostics test, the location on the test component 30 at which the mounting plate should be affixed is specified. During different diagnostics tests different locations for the fixing means 32 may be specified. It is important to control the position and ensure the correct orientation of the diagnostics unit 10 so that the vibration data thereby gathered can be analysed and interpreted correctly in order to accurately diagnose a fault and to accurately identify the device or component on the vehicle 90 that is faulty.

In the diagnostics test being described in relation to FIGS. 1, 2, 3 and 4 a single diagnostic unit 10 is rigidly attached to the transfer case 30 of the vehicle 90 by using the stud of the fixing means 32. The way in which the diagnostics system 100 may diagnose a noise, vibration and harshness (NVH) type vehicle fault will now be described with reference to FIG. 3 and the flow-chart 200 shown therein. The flow chart 200 illustrates how a diagnostics test may be set-up and carried out. During a diagnostics test, one or more or a series of test cycles may be carried out. During each test cycle, the vehicle 90 is driven in accordance with a specified set of conditions. Each test cycle is validated to check that the vehicle 90 was actually driven according to the specified conditions.

Figure 3:
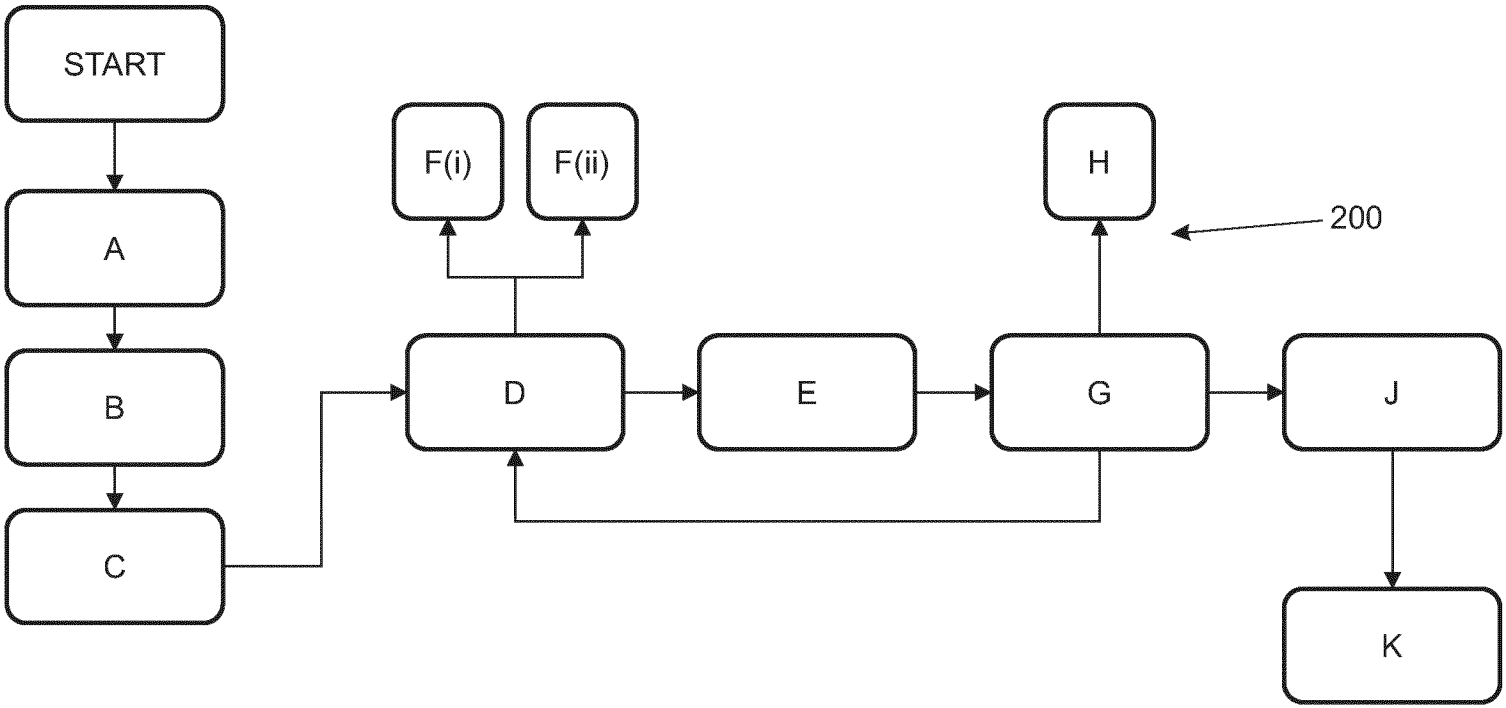
FIG. 3 is a flow-chart illustrating a diagnostics test conducted by the vehicle diagnostics system of FIG. 1 on the test component of the vehicle shown therein.

In FIG. 3, the flow chart 200 comprises the following instructions, steps and/or decisions which may be issued by or conducted by the computing device 50 that is provided within the vehicle 90 during the test or by the diagnostics unit 10:

A: Fasten the diagnostics unit 10 to the test component 30 using the nut of the first attachment means 20 and tether. Check that the diagnostics unit 10 is correctly attached and correctly located;

B: Check Bluetooth® communication (42) is enabled;

C: Issue instructions for the vehicle 90 to be driven in accordance with a set of conditions for the current test cycle—In test cycle one, the pre-set conditions include: a target vehicle speed of 50 mph, a target gear of third gear; and target drive mode of SPORTS MODE. (These conditions thereby set the engine load and drive shaft speed);

D: Validate the test cycle by checking, whether the actual vehicle conditions as determined by the diagnostics apparatus 152 communicating with the vehicle 90 via the connection with the ECU 60 at least substantially match the specified set of conditions. If the conditions are met, then step E follows; if the actual conditions to do not match the specified conditions then steps F(i) or F(ii) follow as appropriate;

E: Gather acceleration data from the first and second accelerometers 28*a*, 28*b*. Whilst the vehicle 90 is being driven in accordance with the set of specified conditions for the test cycle, for one or more time periods, the acceleration of the test component 30 is sampled using the diagnostics unit 10. The accelerometers 28*a*, 28*b* are optionally sampled alternately such that they are not both drawing power simultaneously. This power conservation strategy is entirely optional and should the power source 27 have sufficient capacity to permit it, then both the first and the second accelerometers 28*a*, 28*b* would be sampled at the same time. In the present arrangement however, during each time period, the first accelerometer 28*a* is activated for a first sub-time period, the first ADC 38*a* then converts the analogue output signal to a digital signal input to the microcontroller 29 which communicates via the wireless link 42 to the computer device 50 within the vehicle 90. The second accelerometer 28*b* is then activated for a second sub-time period, the second ADC 38*b* then converts the analogue output signal to a digital signal input to the microcontroller 29 which communicates via the wireless link 42 to the computer device 50 within the vehicle 90. This process is preferably repeated for a number of time periods in order to gather a sufficient quantity of data to make a more accurate diagnostic assessment. For ease of data manipulation and communication during each time period a single data packet is obtained, which optionally may be 16 bytes in length. The low bytes (bytes 1 to 8) contain data from the first accelerometer 28*a* and the high bytes (bytes 9 to 16) contain data from the second accelerometer 28*b*. In this way the source of the data can be identified by the computing device 50. Once the data has been gathered then step G follows;

F(i) To encourage the driver of the vehicle 90 (which is likely to be a technician) to drive the vehicle in accordance with the set conditions for the test, a prompt may be issued to increase drive speed, increase gear or change driving mode for example. The prompt in this embodiment is an audible prompt.

F(ii) To encourage the driver of the vehicle 90 (which is likely to be a technician) to drive the vehicle in accordance with the set conditions for the test, a prompt may be issued to decrease drive speed, decrease gear or change driving mode for example. The prompt in this embodiment is an audible prompt.

Figure 4:
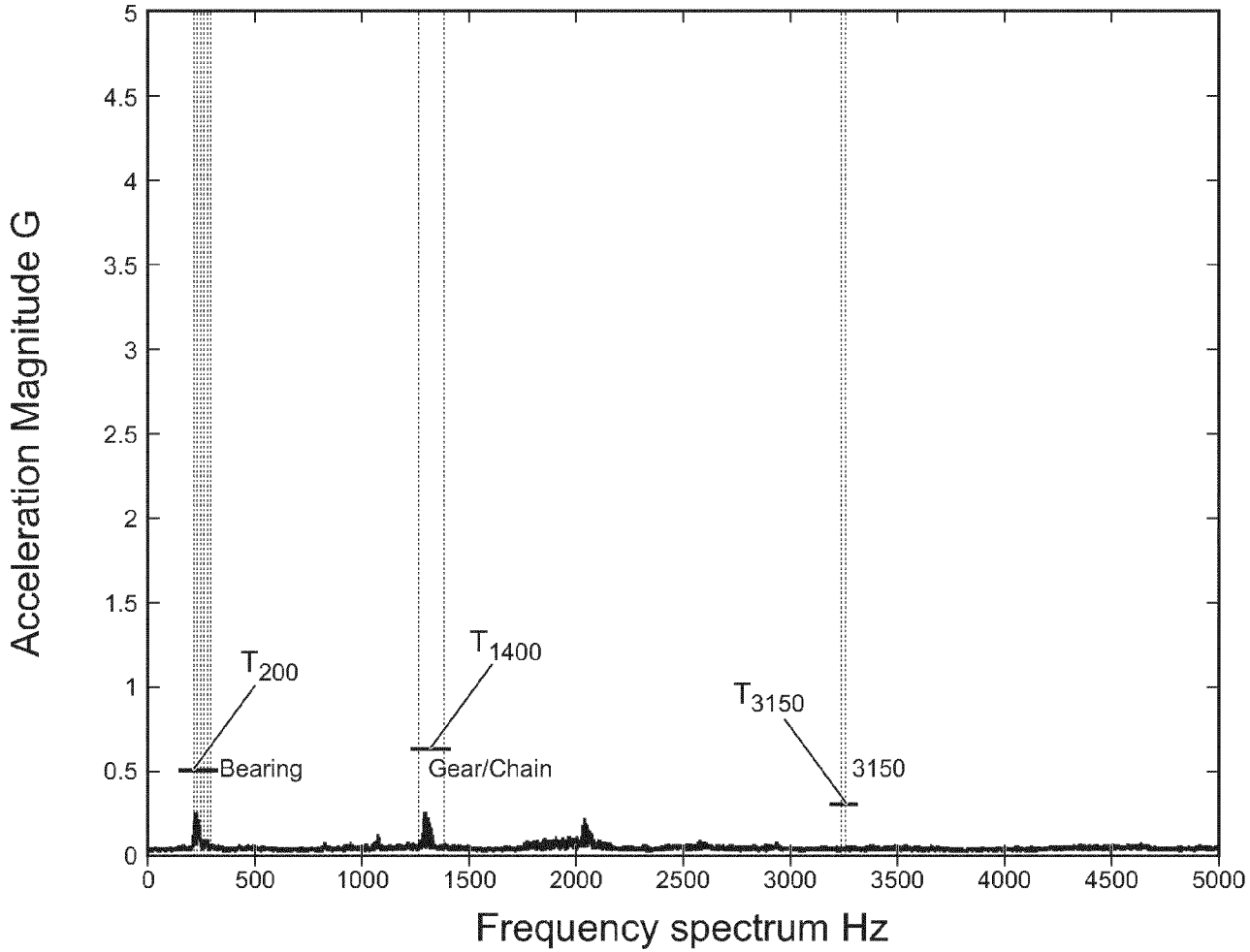
FIG. 4 is a graphical representation of data that may be obtained by the diagnostics apparatus and utilised by a vehicle diagnostics system.
Figure 4B:
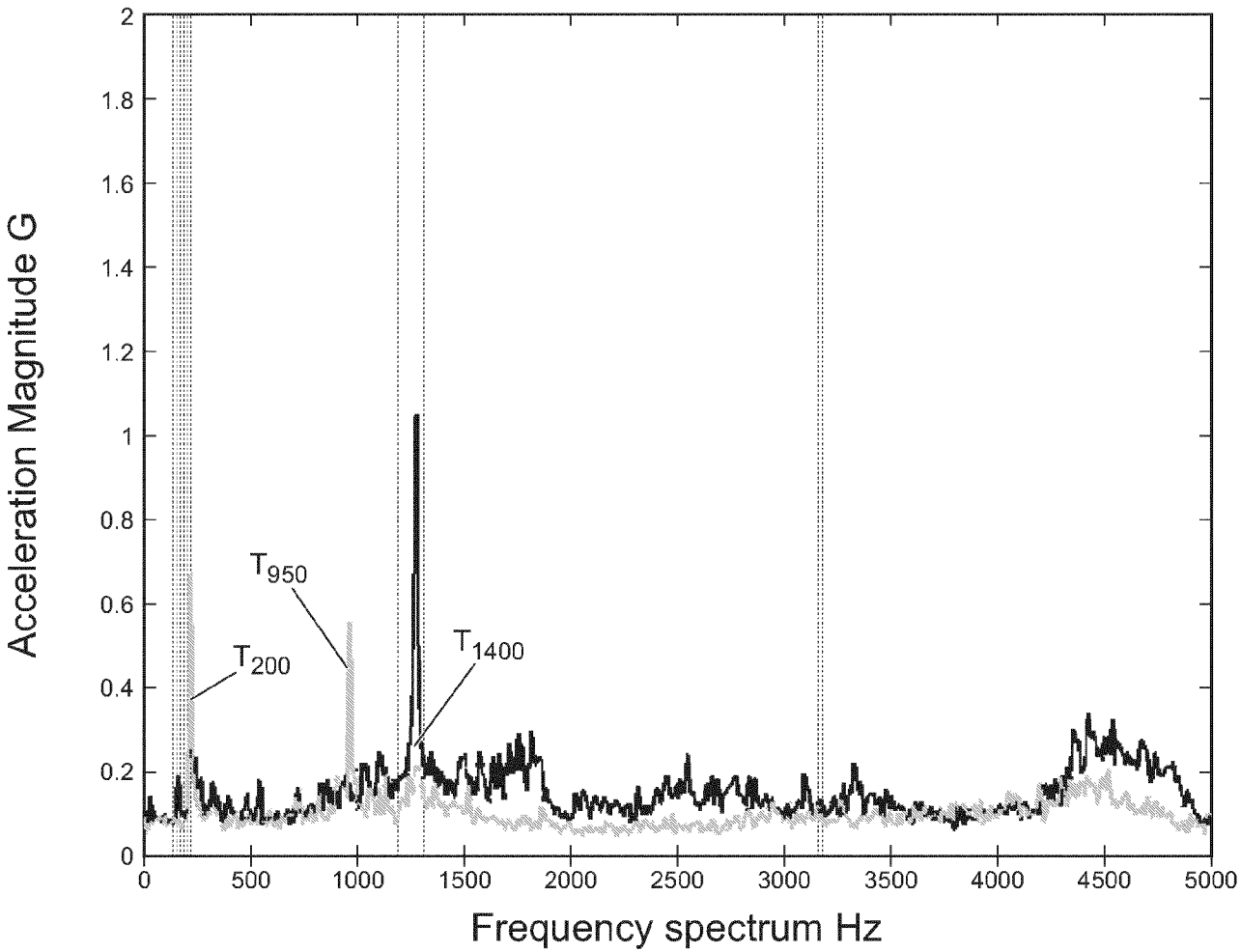
FIG. 4B is another graphical representation of data that may be obtained by the diagnostics apparatus and utilised by a vehicle diagnostics system.

G: Has enough data been gathered? Due to the fact that the vehicle 90 is being driven during the test, it may not be possible for the driver to maintain the pre-set conditions at all times. Data is only gathered when it has been validated that the actual driving conditions are close enough to the specified conditions. As such, there is not a set time period over which the test is conducted, but rather a minimum amount of valid data needs to be collected in order for a test cycle to be completed. It is advantageous to inform the driver that he is required to continue driving within the set conditions or whether he has the freedom to drive outside of the set conditions. Therefore, if sufficient data has been gathered (which may simply be decided by a count of valid data packets and whether a required number of data packets have been obtained), go to step J, otherwise go back to step D and got to step H;

H: Audible alert that test cycle is continuing so that more valid data can be gathered and that specified pre-set conditions need to be maintained;

J: The digitally sampled data obtained during each of the one or more time periods is converted into the frequency domain using a discrete time Fourier transform (dtFT), such that data containing a magnitude of acceleration force against frequency is obtained for each of the one or more time periods. This data is then averaged over the number of time periods for which valid data was obtained. A graphical representation of such converted and averaged data is shown in FIG. 4. The diagnostics system 100 according to the disclosure is not configured to output graphical data of this kind and the graph of FIG. 4 is provided only as an illustration to the reader. After the conversion an analysis is conducted at step K;

K: Assign a pass or fail for each vibration frequency signature of the test component 30. In the example of a transfer case 30 being tested, the vibration data obtained may be made up of vibrations from a number of components (bearing, chain, gear) depending which are faulty (non-faulty components would have a magnitude of acceleration below the threshold). In analysing the obtained data, the computing device 50 may first determine whether any acceleration force magnitudes in any of the frequency bands are above a threshold for any device that may be contained in the transfer case 30. Then, based upon a further analysis of the data the computing device may determine whether the test data contains readings that are characteristic of one or more components of the transfer case 30 being faulty. In FIG. 4 three frequency bands or orders have been marked out by vertical lines. These correspond to: a bearing within the transfer case 30 and a gear or chain within the transfer case 30. A single frequency band or order may be insufficient on its own to identify a faulty component, but in combination a variety of characteristics may be used. For example, a faulty device may give rise to two peaks at difference frequency bands and the pass/fail threshold for each of these frequency bands may be the same or different. The magnitude of acceleration at more than one frequency band or order can be used together, with a greater degree of accuracy, to identify a faulty component. The order used may not necessarily be a first order, for example, at a drive shaft speed of 37 Hz, a gear contained in the transfer case 30, if faulty may show a peak of 0.5 g or more in the 1400 Hz frequency band (which corresponds to a $35^{th}$ order of a 37 Hz vibration). As such, the vibration frequency signature characteristics for the gear may be quantified by a first threshold $T_{1400}$ (see FIG. 4). Other components may be identifiable in the same way and each test component may have a different set of vibration frequency characteristics at different drive conditions. In the graph of FIG. 4, the gear passes the diagnostic test because when the predetermined upper and/or lower threshold ($T_{1400}$) is applied to the string of data making up the graph in FIG. 4, it is found that the magnitudes of the vibrations at the frequency band or order (1400 Hz) is below the threshold $T_{1400}$ and is within the set limits. In FIG. 4B, the gear and bearing both fail the test because peaks $T_{200}$ and $T_{950}$ exceed the first and second thresholds for the bearing and because the peak $T_{1400}$ exceeds a first threshold for the gear.

Because the diagnostics test is being conducted in response to an observed NVH type fault, the presumption is that a fault exists. Therefore after determining from the first test cycle at 50 mph that the test component is a PASS, the diagnostic system 100 of the present disclosure is configured to conduct more tests. A voting strategy is optionally adopted wherein a counter of the results stores the total number of test cycles and the results of each test cycle. A maximum number, for example 7, test cycles may be performed within a single diagnostics test for a single component 30. A critical number of FAILS fails may be required in order for the diagnostic system 100 to determine with a reasonable degree of confidence that the component 30 under test is faulty. The critical number of FAILS may be 4. Step C is repeated for second and subsequent test cycles for a minimum of the critical number of test cycles (e.g. 4 or more) provided that step C is not repeated more than the maximum number of test cycles. At the end of the diagnostic test, if a critical number of fails has been observed then the faulty component has been identified. If the maximum number of test cycles has been reached but the critical number of fails has not been reached, then the faulty component has not been found, but a component has been eliminated as being faulty. In this latter scenario, testing of other vehicle components may be necessary in order to isolate and identify the faulty part. Step L follows;

L: A diagnostic report is issued in which it may be stated that one or more vehicle components (that can be identified by their predetermined frequency band) is faulty; that one or more vehicle components should be replaced; and/or that testing of other devices or components of the vehicle 90 should be conducted. An audible alert may be issued to inform the technician that the diagnostic has been completed.

A further aspect of the disclosure that may be used in the context of the diagnostics system 100 being described (and which may have a wider application in sensor technology, is the verification that the first and second accelerometers 28*a*, 28*b* are operating normally, i.e. within calibration. Data from the first accelerometer 28*a* is compared with the data from the second accelerometer 28*b*, which data is preferably obtained within a sampling period. Giving consideration to tolerance of the first and second accelerometers 28*a*, 28*b* and the resolution of the data output either by the first and second accelerometers 28*a*, 28*b* or by the ADCs 38*a*, 38*b* some additional analysis is preferably, but nevertheless optionally, carried out in order to verify that the first and second accelerometers 28*a*, 28*b* are both working properly (i.e. they are operating within their expected tolerances). This may be done by comparing a mean of the data from the first accelerometer 28*a* with a mean 28*b* of the data from the second accelerometer; and/or by comparing a standard deviation of the data from the first accelerometer 28*a* with a standard deviation of the data 28*b* from the second accelerometer. The mean values should be 0 and the standard deviation should be the typical acceleration experienced during the sample period. This verification is conducted periodically during the test cycle to ensure that the first and second accelerometers 28*a*, 28*b* are not exhibiting any unusual characteristics or behaviour that may be indicative of one or both of them being faulty and therefore the diagnostic test not being accurately carried out.

The sampling period referred to may be the same duration as each of said one or more time periods or may be shorter or longer and more intermittent. As discussed above, during each sampling period the first and second accelerometers 28*a*, 28*b* are preferably alternately sampled to conserve power. In other embodiments, during each calibration sampling period the first and second accelerometers are simultaneously sampled.

It can be appreciated that various changes may be made within the scope of the present invention, for example, in other embodiments of the invention it is envisaged that the test component of the vehicle is selected from the group comprising: crank-shaft, front differential gear, rear differential gear. The device that may be identified by the diagnostics test may be attached to or contained within the test component and may be selected from the group comprising: timing chain, gear, bearing, fly-wheel, injector and diesel injector pintle valve. The type and number of test component that the diagnostics unit 10 can be attached to and the type and number of devices that can thereby be tested are many and various.

Figure 5:
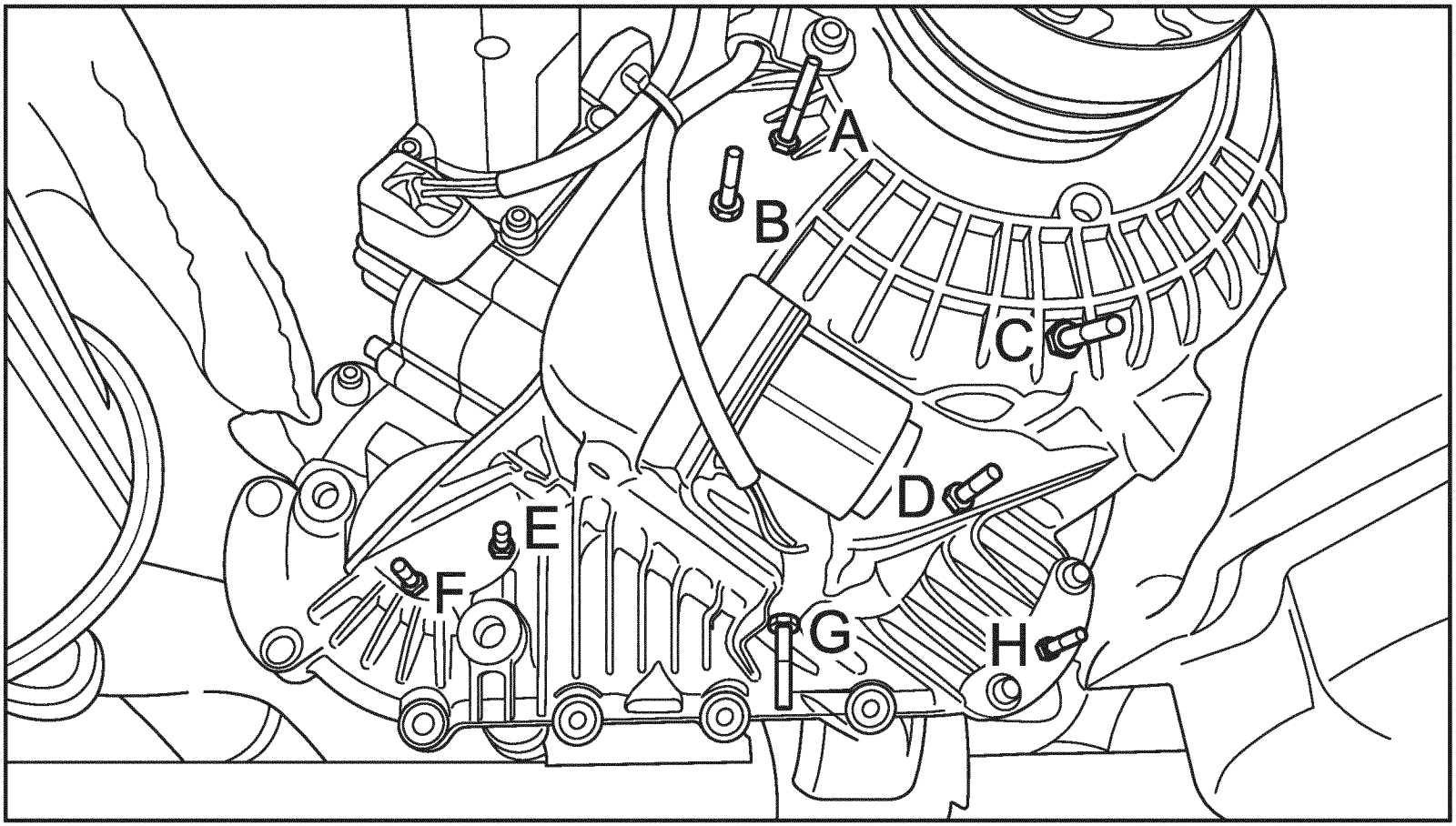
FIG. 5 is a perspective view from the top of part of a test component (a transfer case) in which a series of fixing means are shown affixed to the transfer case at different locations.

Additionally, in other envisaged embodiments, more than one diagnostics unit 10 may be simultaneously attached to more than one test component of the vehicle 90 and/or more than one diagnostics unit 10 may be simultaneously attached to the same test component 30 but at different locations thereon and/or in different axial orientations relative to one another. Reference is briefly made to FIG. 5 wherein eight studs 32 are affixed to a transfer case of a four-wheel drive vehicle 90 at eight different locations and axial orientations. The locations are labeled A to H.

In other embodiments it is envisaged that one or more fixing means are integrally formed in a component of a vehicle. For example, rather than having a fixing means mounted by adhesive to an outer surface of a transfer case during testing, the transfer case may be manufactured with a fixing stud or fixing element integrally formed therewithin, ready for a diagnostics unit 10 to be attached thereto. The advantage of such an arrangement is that the location of the fixing means on the test component is fixed at manufacture and therefore highly controlled. The accuracy of the location of the fixing means impacts the accuracy of the test being conducted.

In other embodiments, it is envisaged that the diagnostics unit in addition or in alternative to having a wireless communications means, may be provided with a memory means, for storing gathered data and the time that the data was gathered. After running the vehicle at pre-set control conditions, the diagnostics unit could be coupled to a computing device for transferring the stored data, which could then be validated, converted, averaged, analysed and interpreted as before. Such an arrangement may take longer to conduct the test (since multiple test cycles might be carried out at different pre-set conditions), but the quantity of data gathered might be greater and such an arrangement may provide a more accurate assessment of the test component. The processing time required to process the gathered data may also be increased, however, the power consumption of the diagnostics unit may be reduced due to not having an active wireless communications link.

In yet further envisaged embodiments the, or each accelerometer comprised in the diagnostics apparatus is configured to gather acceleration data in two or three different axial directions. In a particular envisaged embodiment, a single three-axis accelerometer is used; in another embodiment two three-axis accelerometers are provided.

The invention claimed is:

1. A method of detecting a noise, vibration and harshness (NVH) type vehicle fault, the method comprising performing one or more test cycles, wherein each test cycle comprises:

issuing control instructions for a vehicle to be driven in accordance with a set of control conditions for each test cycle;

while the vehicle is being driven in accordance with the set of control conditions, digitally sampling, for one or more time periods, the acceleration data of a test component in a first axial direction;

converting the digitally sampled acceleration data obtained during each of the one or more time periods into the frequency domain, such that data of acceleration force against frequency is obtained for each of the one or more time periods;

applying predetermined upper and/or lower acceleration force limits for each of one or more predetermined frequency bands, said predetermined frequency bands identify one or more vehicle components;

assigning a pass or fail for each of said one or more predetermined frequency bands in dependence upon whether the acceleration force at each of said one or more predetermined frequency bands falls within or falls outside of the predetermined upper and/or lower acceleration force limits; and upon assigning a critical number of fails within a maximum number of test cycles, detecting that one or more vehicle components or devices contained therein is faulty.

2. A method according to claim 1, wherein said set of conditions for each test cycle comprises a specified vehicle target speed, a specified driving mode, a specified vehicle transmission gear, a specified drive shaft speed and/or a specified engine load.

3. A method according to claim 1, wherein the method comprises validating the test cycle by: during the test cycle, continuously or intermittently, checking whether the actual vehicle conditions at least substantially match the set of conditions.

4. A method according to claim 3, wherein said validating the test cycle is conducted before the digitally sampling, for one or more time periods, the acceleration of a vehicle component in a first axial direction and wherein upon determining that the test cycle is not yet valid, performing at least one of not digitally sampling, for one or more time periods, the acceleration of a vehicle component in a first axial direction; and, continuing the test cycle with said set of conditions for the test cycle and issuing correction instructions to encourage the vehicle to be driven in accordance with the set of conditions for the test cycle.

5. A method according to claim 1, wherein, after said converting the digitally sampled data obtained during each of the one or more time periods into the frequency domain, the data of acceleration force against frequency obtained for each of the one or more time periods is averaged over the total number of said one or more time periods and wherein the assigning a pass or fail is thereby carried out once per test cycle.

6. A method according to claim 1, wherein said digitally sampling comprises using a diagnostics unit comprising:

an attachment member configured to rigidly attach the diagnostics unit to a vehicle component;

a sensor that detects velocity or acceleration in at least one axial direction; and at least one of:

memory for containing data generated by the sensor; and a transmitter that transmits data from the diagnostics unit to an external diagnostics apparatus.

7. A method according to claim 6, wherein the sensor comprises a first accelerometer and a second accelerometer, and wherein the method additionally comprises comparing data from the first accelerometer and data from the second accelerometer obtained within a sampling period in order to verify that the first and second accelerometers are within calibration.

8. A method according to claim 7, wherein during each sampling period the first and second accelerometers are alternately sampled or wherein during each sampling period the first and second accelerometers are simultaneously sampled.

9. A method according to claim 7, wherein said comparing the data from the first accelerometer and the data from the second accelerometer obtained within a sampling period in order to verify that the first and second accelerometers are within calibration comprises:

comparing a mean of the data from the first accelerometer with a mean of the data from the second accelerometer; and/or, comparing a standard deviation of the data from the first accelerometer with a standard deviation of the data from the second accelerometer.

10. A non-transitory computer readable medium containing instructions for a processor to implement the method of claim 1.

11. A non-transitory storage medium carrying computer readable code for controlling a vehicle to carry out the method of claim 1.

12. A diagnostics unit for use with an external diagnostics apparatus for detecting a noise, vibration, harshness (NVH) type vehicle fault, the diagnostics unit comprising:

a first attachment member for rigidly attaching the diagnostics unit to a component of a vehicle;

a sensor for detecting changes in velocity and/or acceleration in at least one axial direction;

a power source coupled to the sensor; and at least one of a memory for storing data gathered by the sensor; and, a transmitter configured for wired or wireless transmission of live or stored data from the diagnostics unit to the external diagnostics apparatus; and, wherein the power source is coupled to the at least one of the transmitter and the memory.

13. A diagnostics unit according to claim 12, wherein the sensor comprises at least one accelerometer selected from the group comprising: a capacitive accelerometer, a piezoelectric accelerometer, a piezoresistive accelerometer and a Hall effect accelerometer.

14. A diagnostics unit according to claim 13, wherein the sensor comprises a first accelerometer and a second accelerometer and wherein the first accelerometer and the second accelerometer are configured to detect acceleration in only one axial direction and in the same axial direction.

15. A diagnostics unit according to claim 14, wherein the first accelerometer is a piezoelectric accelerometer and wherein the second accelerometer is a MEMS accelerometer.

16. A diagnostics unit according to claim 15, wherein the first accelerometer has an operating range of −20 g to 20 g and wherein the second accelerometer has an operating range of −70 g to 70 g.

17. A diagnostics unit according to claim 14, wherein the diagnostics unit comprises a first analog to digital converter for said first accelerometer and a second analog to digital converter for said second accelerometer.

18. A vehicle comprising a component, a complementary fixing member mounted to said component of the vehicle and comprising a diagnostics unit comprising a first attachment member for rigidly attaching the diagnostics unit to a component of a vehicle;

a sensor for detecting changes in velocity and/or acceleration in at least one axial direction;

at least one of:

a memory for storing data gathered by the sensor; and a transmitter configured for wired or wireless transmission of live or stored data from the diagnostics unit to the external diagnostics apparatus; and a power source coupled to the sensor and the at least one of the transmitter and the memory;

wherein said attachment member for rigidly attaching the diagnostics unit to a component of a vehicle is rigidly affixed to said complementary fixing member.

19. A vehicle according to claim 18, wherein the attachment member of the diagnostics unit comprises a screw thread and is structured and arranged such that when the attachment member is screw-fixed to the fixing member on said component of the vehicle, the sensor is accurately positioned for detecting a force of acceleration in at least one axial direction that is parallel to a notional axis passing through the center of the attachment member.

20. A vehicle according to claim 18, wherein said fixing member comprises a mounting plate and a stud, said stud structured and arranged for screw-fixing the attachment member of the diagnostics unit thereto and the mounting plate for attaching the fixing member to said component of the vehicle in a correct orientation.

21. A vehicle according to claim 18, wherein said component of the vehicle to which the diagnostics unit is rigidly attached contains a device or is connected to a device giving rise to the noise, vibration, harshness (NVH) type vehicle fault and wherein said device is selected from the group comprising: crank-shaft, timing chain, gear, differential gear, bearing, fly-wheel, injector and diesel injector pintle valve.

22. A diagnostic apparatus for a vehicle comprising one or more diagnostics units, a computing device coupled to the one or more diagnostics units and a program executable by the computing device, said one or more diagnostic units comprising:

a first attachment member for rigidly attaching the diagnostics unit to a component of a vehicle;

a sensor for detecting changes in velocity and/or acceleration in at least one axial direction;

at least one of:

a memory for storing data gathered by the sensor; and a transmitter configured for wired or wireless transmission of live or stored data from the diagnostics unit to the external diagnostics apparatus; and a power source coupled to the sensor and the at least one of the transmitter and the memory;

said computing device executing said program to perform a method of diagnosing a noise, vibration and harshness (NVH) type vehicle fault, the method comprising performing one or more test cycles, wherein each test cycle comprises:

issuing instructions for a vehicle to be driven in accordance with a set of conditions for each test cycle;

while the vehicle is being driven in accordance with the set of conditions, digitally sampling, for one or more time periods, the acceleration of a test component in a first axial direction;

converting the digitally sampled data obtained during each of the one or more time periods into the frequency domain, such that data of acceleration force against frequency is obtained for each of the one or more time periods;

applying predetermined upper and/or lower acceleration force limits for each of one or more predetermined frequency bands, said predetermined frequency bands identify one or more vehicle components;

assigning a pass or fail for each of said one or more predetermined frequency bands in dependence upon whether the acceleration force at each of said one or more predetermined frequency bands falls within or falls outside of the predetermined upper and/or lower acceleration force limits; and upon assigning a critical number of fails within a maximum number of test cycles, issuing a diagnostic report that one or more vehicle components or devices contained therein is faulty; that one or more vehicle components should be replaced; or upon not assigning a critical number of fails within the maximum number of test cycles, issuing a diagnostic report that other devices of the vehicle need to be tested.

* * * * *